United States Patent [19]

Bentivenga et al.

[11] Patent Number: 5,023,579

[45] Date of Patent: Jun. 11, 1991

[54] INTEGRATED BANDPASS/LOWPASS FILTER

[75] Inventors: Salvatore Bentivenga; Michael J. Bentivenga, both of Parlin, N.J.

[73] Assignee: Radio Frequency Systems, Inc., Marlboro, N.J.

[21] Appl. No.: 550,720

[22] Filed: Jul. 10, 1990

[51] Int. Cl.[5] ..... H01P 1/205

[52] U.S. Cl. ..... 333/203; 333/206; 333/223

[58] Field of Search ..... 333/202, 203, 206, 207, 333/185, 222–224, 219, 219.1, 235

[56] References Cited

U.S. PATENT DOCUMENTS

| | | | |
|---|---|---|---|
| 2,438,913 | 4/1948 | Hansen | 333/206 |
| 4,037,182 | 7/1977 | Burnett et al. | 333/203 |
| 4,680,560 | 7/1987 | Yorita et al. | 333/206 |

*Primary Examiner*—Eugene R. LaRoche
*Assistant Examiner*—Seung Ham
*Attorney, Agent, or Firm*—Ware, Fressola, Van Der Sluys & Adolphson

[57] ABSTRACT

A bandpass/lowpass filter comprises a bandpass filter with two or more resonators with the first and last resonators coupled to associated connectors. Corresponding lowpass filters are positioned within the first and last resonators, wherein each lowpass filter comprises a plurality of low impedance and high impedance elements. A disk emanates from each of these integrated lowpass filters so as to couple the filtered electromagnetic energy to the bandpass filter. The overall result is an integrated filter having a desired bandpass with significant suppression of spurious frequencies. The overall integrated filter is significantly smaller than conventional filters using external inline lowpass filters.

30 Claims, 8 Drawing Sheets

STANDARD 7 POLE COMBLINE USING INPUT COUPLING LOOP

STANDARD 7 POLE COMBLINE USING INPUT COUPLING ROD

SEMI-LUMPED COAXIAL LOWPASS FILTER

STANDARD 7 POLE COMBLINE WITH TWO LOWPASS FILTERS

INTEGRATED BANDPASS/LOWPASS FILTER

TECHNICAL FIELD

The present invention is directed to electromagnetic filters and particularly such filters operating in the microwave frequency range. It is particularly directed to the combination of a bandpass filter with a lowpass filter or in any multi-filter application that requires coaxial resonators.

BACKGROUND OF THE INVENTION

A bandpass filter which, as its name implies, is designed to allow electromagnetic energy to pass which is within a band of permissible frequencies. Such filters are commonly used in ultra-high frequency and microwave applications. A typical bandpass filter of the combline type is shown in FIG. 1. This figure illustrates a seven pole combline filter, where each pole is the result of a single resonator. These resonators are typically placed in parallel to each other with a ground plane surrounding them. The resonators need not be of the same physical size with respect to either their length or their diameter.

The number of resonators determines the order of the filter, while the spacing between the resonators determines the filter characteristics such as its bandwidth and impedance. Input and output coupling can be achieved using various methods including coupling loops as shown in FIG. 1 or coupling rods as shown in FIG. 2.

A thorough discussion with respect to the design of such combline filters and other type of bandpass filters is presented in *Microwave Filters, Impedance-Matching Networks, and Coupling Structures,* by G. Matthaei, L. Young and E. M. T. Jones (Artech House Books—Dedham, Massachusetts, Copyright 1980).

A bandpass filter, including the combline filter as described above, generally has an adequate response with respect to its desired bandpass of frequencies but also exhibits spurious responses with respect to some frequencies outside of the bandpass. The spurious responses typically occur near the odd multiples of quarter wavelengths of the bandpass frequency, but may also appear at other frequencies as shown in FIG. 3, which illustrates the typical response for the combline filter shown in FIGS. 1 or 2.

As a result, most prior art bandpass filters use one or more external lowpass filters which are added inline with the bandpass filter so as to reduce the unwanted spurious response of the bandpass filter. The lowpass filters act as harmonic and non-harmonic suppression filters since they are configured to pass only those frequencies lower than a desired frequency, which frequency is set to be slightly higher than the highest frequency of the bandpass filter. The amount of attenuation added is directly related to the lowpass filter design as well as the number of poles in the lowpass filter. FIG. 4 illustrates a typical lowpass filter while FIG. 5 illustrates the use of such a filter in combination with a combline bandpass filter.

The problems associated with the combination of two or more lowpass filters inline with a bandpass filter include the additional space required for each lowpass filter as well as the multiple connectors required for connecting each lowpass filter to the bandpass filter and the associated transmission waveguides.

The present invention overcomes these two basic difficulties encountered with prior art designs by incorporating a lowpass filter within the body of the bandpass filter, and in particular, to incorporate the lowpass filter within a resonator forming part of the bandpass filter. This incorporation eliminates the need for additional housing otherwise required for the lowpass filter. The total filter is smaller, thereby requiring less space for its installation.

The total number of parts associated with this integrated bandpass/lowpass filter is also reduced in comparison to prior art filter designs and in particular the number of connectors is reduced, thereby reducing the cost of the overall filter as well as eliminating potential electromagnetic losses associated with such additional connectors.

SUMMARY OF THE INVENTION

The present invention is directed to an integrated bandpass/lowpass filter in which one or two lowpass filters act as a suppression filter and are integrally formed within resonators of the bandpass filter so as to provide the overall bandpass characteristics desired while eliminating the external housing and connectors associated with one or more inline lowpass filters used in combination with a conventional bandpass filter. The lowpass filter associated with the integrated filter of the present invention comprises semi-lumped coaxial elements and provides coupling to the remaining resonators within the bandpass filter through use of a protruding copper disk. Two such integrated lowpass filters may be formed within a bandpass filter such as a combline filter. These lowpass filters are formed within the resonators associated with the input and output connectors of the bandpass filter.

By being incorporated within a resonator forming the bandpass filter, the lowpass filter effectively requires no additional space for its fabrication. This design therefore greatly reduces the overall space requirements associated with combined external lowpass filters inline with an associated bandpass filter, as well as eliminates the input and output connectors normally associated with such external lowpass filters. The resulting design therefore requires substantially less space for its implementation and eliminates up to four connectors. The present invention therefore reduces the overall cost of the integrated bandpass/lowpass filter and reduces the electromagnetic losses which otherwise would be associated with the extra connectors required by external lowpass filters.

Coupling of the output of each lowpass filter to the bandpass filter is achieved by a copper disk which emanates from the other semilumped elements of the lowpass filter and extends outwardly from the resonator within the space defined by the bandpass filter cavity housing.

It is therefore a principal object of the present invention to provide an integrated bandpass/lowpass filter in which the lowpass filter comprises semi-lumped coaxial elements which are housed within the input and/or output resonators associated with the input and/or output connectors of the bandpass filter; thereby reducing the overall housing requirements otherwise necessary for externally connected inline lowpass filters.

Another object of the present invention is to provide an integrated bandpass/lowpass filter in which coupling from the lowpass filter to the bandpass filter is achieved through an associated copper disk projecting from the termination of the resonator housing the lowpass filter coaxial elements.

A further object of the present invention is to provide an integrated bandpass/lowpass filter in which the bandpass filter is of the combline design.

A still further object of the present invention is to provide an integrated combination filter wherein one filter uses resonators housed within a cavity and the second filter is housed within at least one of the resonators.

Other objects of the present invention will in part be obvious and will in part appear hereinafter.

BRIEF DESCRIPTION OF THE DRAWINGS

For a fuller understanding of the nature and objects of the present invention, reference should be made to the following detailed description taken in connection with the accompanying drawings, in which.

BEST MODE FOR CARRYING OUT THE INVENTION

Figure 1:
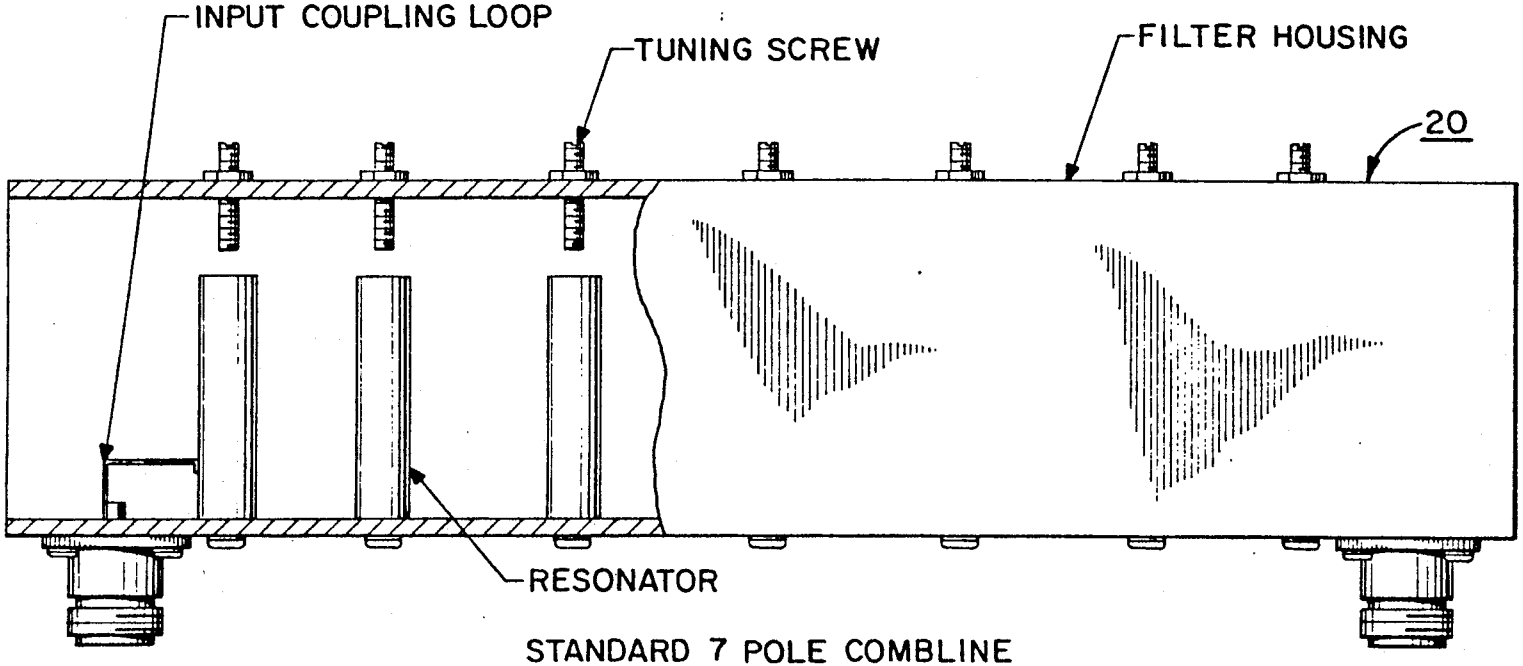
FIG. 1 (PRIOR ART)
FIG. 1 illustrates a prior art combline type bandpass filter incorporating a plurality of resonators within a filter cavity housing, and wherein an input coupling loop is used to couple the input connector to the housing with a similar arrangement for the output connector.
Figure 2:
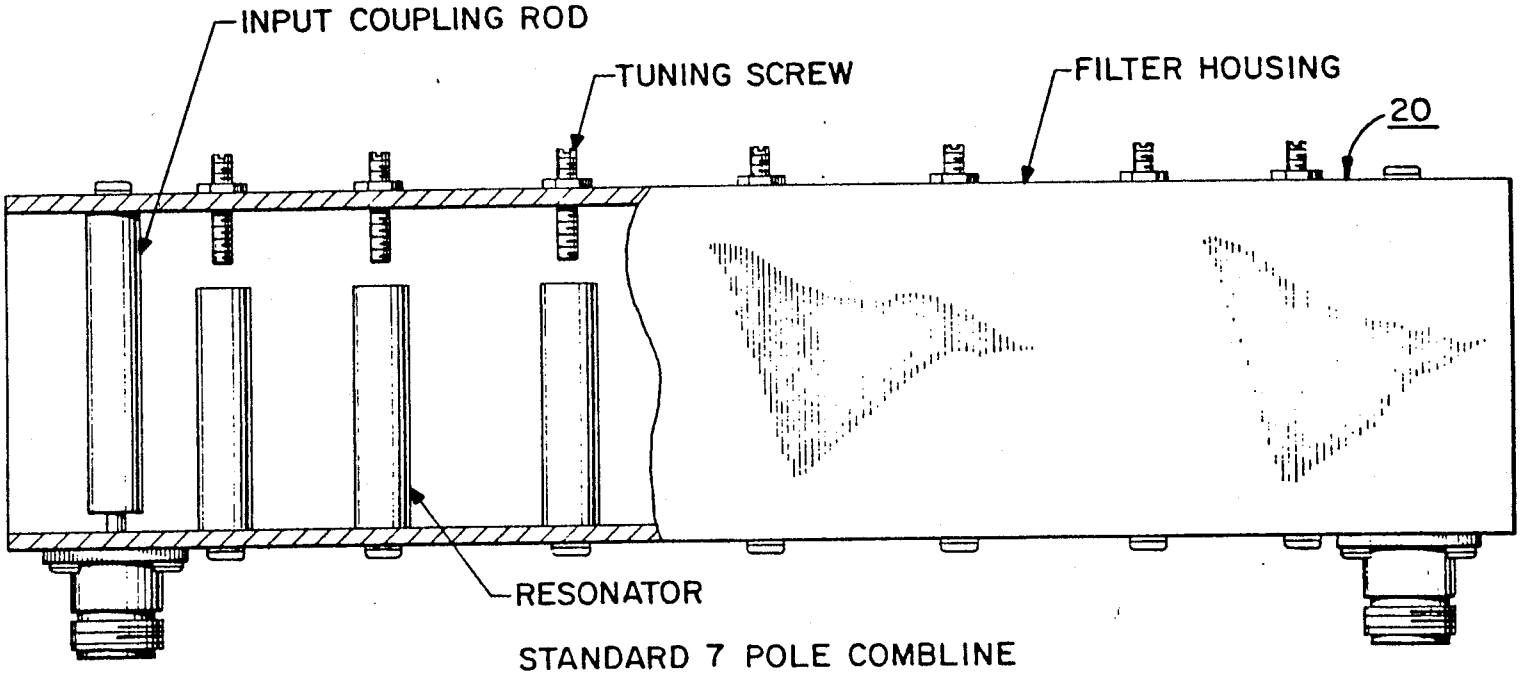
FIG. 2 (PRIOR ART)
FIG. 2 illustrates a prior art combline filter similar to that shown in FIG. 1, in which the input and output coupling is performed through respective coupling rods.

As best seen in FIGS. 1 and 2, prior art bandpass filters 20 of the combline design comprise a series of resonators 22, each with a tuning screw 24 and a pair of connectors 26 and 28 which are interconnected with the resonators by either a coupling loop 30 or a coupling rod 32. The actual design of such a bandpass filter can be determined through either empirical methods or direct calculation methods such as those discussed in the *Microwave Filters, Impedance-Matching Networks, and Coupling Structures,* G. Matthaei, L. Young, and E. M. T. Jones, (Artech House Books, 1980, pp 497–506, 516–518, 977–988).

Figure 3:
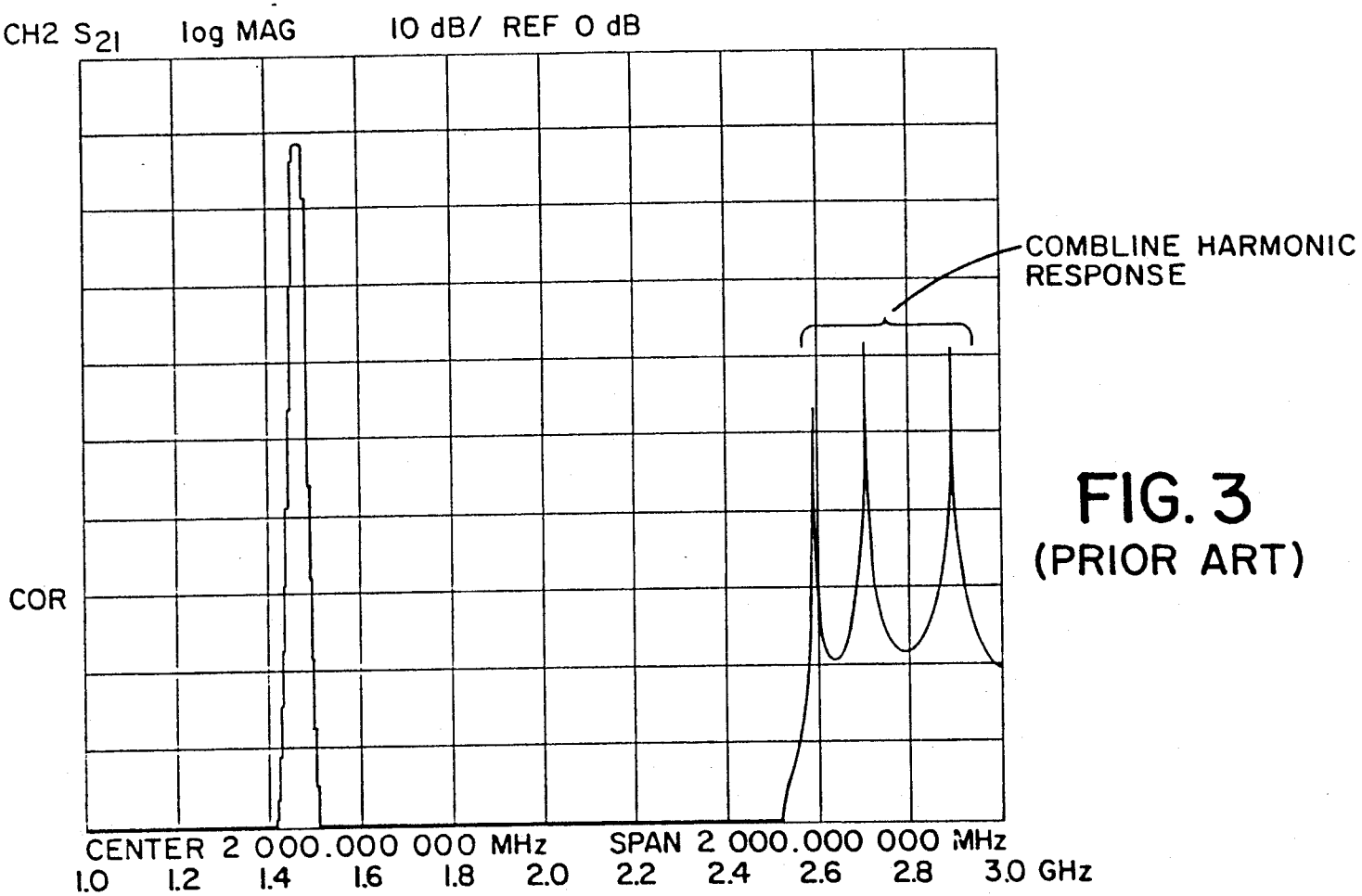
FIG. 3 (PRIOR ART)
FIG. 3 is a response curve for a typical combline filter such as that shown in FIGS. 1 and 2, illustrating its bandpass centered at approximately 1.45 gigahertz (GHz) as well as spurious response beginning at approximately 2.5 GHz.
Figure 4:
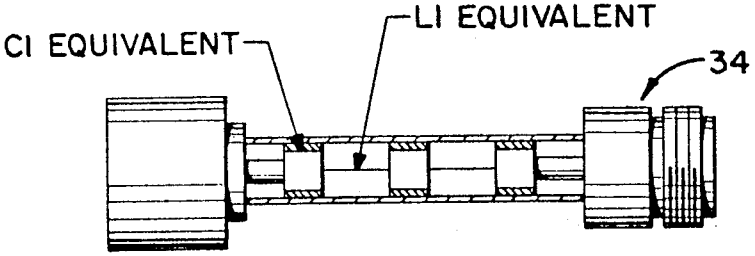
FIG. 4 (PRIOR ART)
FIG. 4 is a prior art semi-lumped coaxial lowpass filter shown partially in section so as to illustrate the semi-lumped inductor and capacitive elements as well as illustrating the connectors forming part of the filter.
Figure 5:
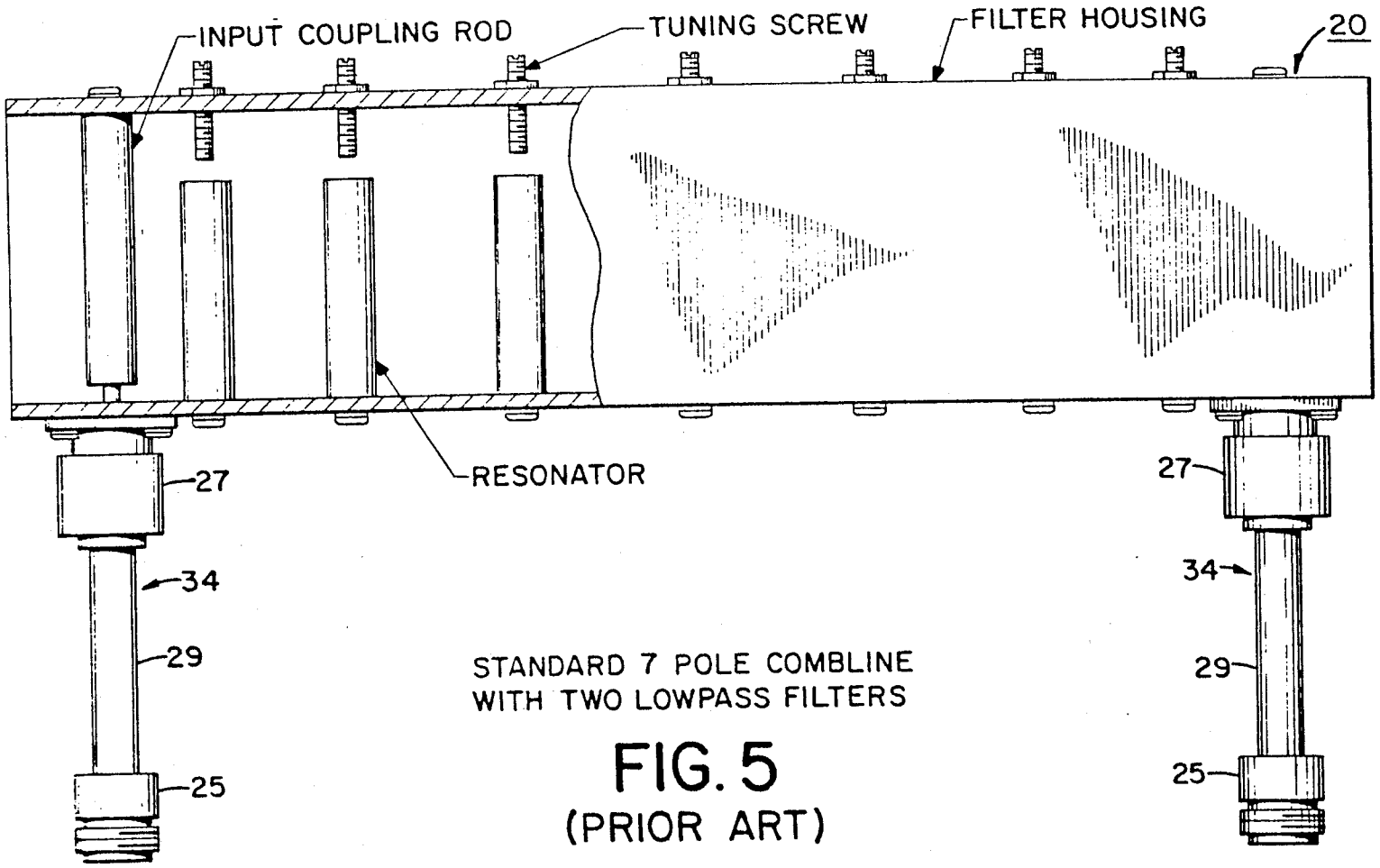
FIG. 5 (PRIOR ART)
FIG. 5 illustrates a prior art combline bandpass filter with two lowpass filters in series therewith, using an input coupling rod forming part of the combline filter.

The typical response curve for a combline bandpass filter is shown in FIG. 3. As seen there, besides the desired bandpass frequencies, which in the example shown centers at about 1.45 gigahertz (GHz), there are a number of spurious harmonic and non-harmonic frequencies starting at about 2.5 GHz and extending beyond 3.0 GHz which are also passed by such a filter. If the combline bandpass filter is being used in a transmit application, the passing of such higher frequencies can result in interference with other frequency allocations. As a result, combline and other types of bandpass filters, such as interdigital filters, are traditionally combined in series with semi-lumped coaxial lowpass filters 34 such as shown in FIG. 4. The lowpass filter or filters are connected to the combline bandpass filter in a manner as shown in FIG. 5. The amount of attenuation added by such filters is directly related to the lowpass filter design; such as, a chebyscheff or butterworth type of filter design, as well as the number of poles in the lowpass filter. Such extra lowpass external filters require additional space in the overall filter design and add cost to the overall system due to the increased number of components.

Figure 7A:
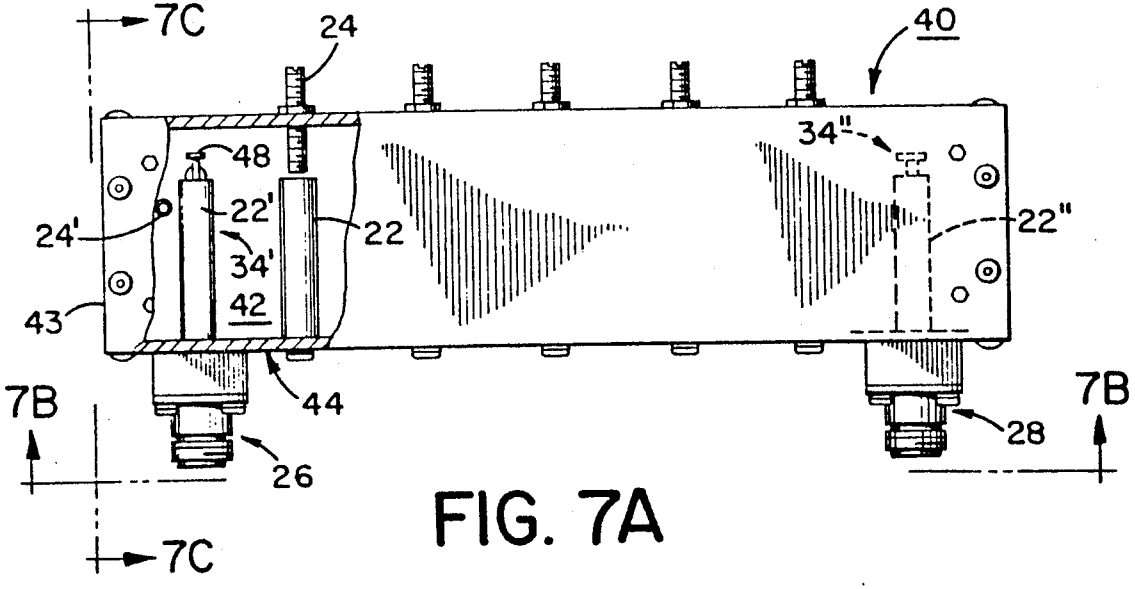
FIG. 7A is a partially cutaway top view of the integrated bandpass/lowpass filter according to the present invention showing the integrated lowpass suppression filter housed within the resonator associated with the input connector to the bandpass filter, as well as illustrating the tuning screws associated with the resonators.
Figure 7B:
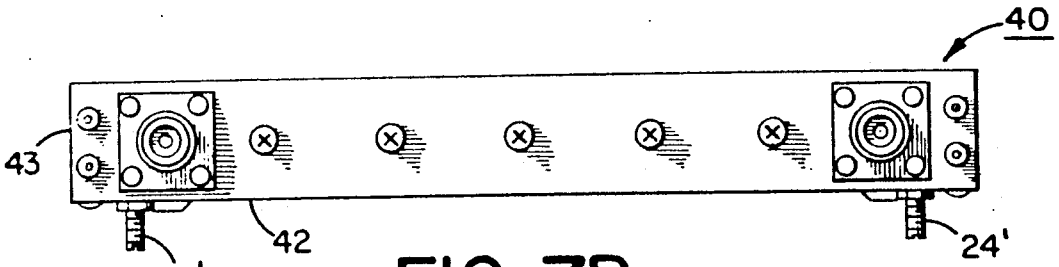
FIG. 7B is a side elevational view of the integrated bandpass/lowpass filter shown in FIG. 7A, taken along line 7B—7B of FIG. 7A.
Figure 7C:
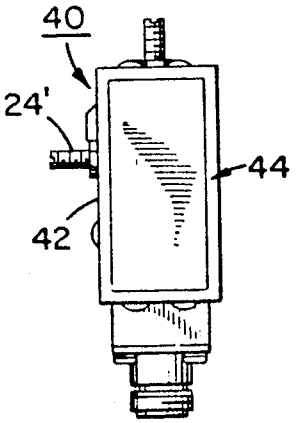
FIG. 7C is an end elevational view of the integrated bandpass/lowpass filter shown in FIG. 7A and 7B, taken along lines 7C —7C of FIG. 7A.

The present invention provides a solution to the use of inline external lowpass filters in combination with a combline or other types of bandpass filter by presenting an integrated bandpass/lowpass filter 40 such as shown in FIGS. 7A–7C. This integrated bandpass/lowpass filter comprises seven resonators 22 similar in design to the resonators shown in FIGS. 3 and 4 and also incorporates tuning screws 24 for adjusting the center frequency of operation with respect to each such resonator. It should be noted however, that the resonator associated with connector 26 and the resonator associated with connector 28 (resonator not shown) have their respective tuning screws 24' emanating from the lower surface 42 of the rectangular cavity housing 44, as best seen in FIG. 7A–7C.

Figure 6D:
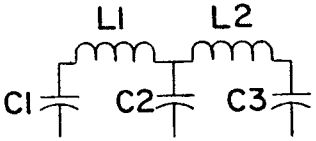
FIG. 6D is the electrical schematic for the lowpass filter shown in FIGS. 6A and 6C.
Figure 6B:
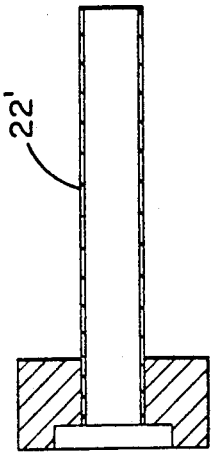
FIG. 6B is a cross-sectional view of the input resonator in which the semi-lumped elements of the lowpass suppression filter are housed.
Figure 6A:
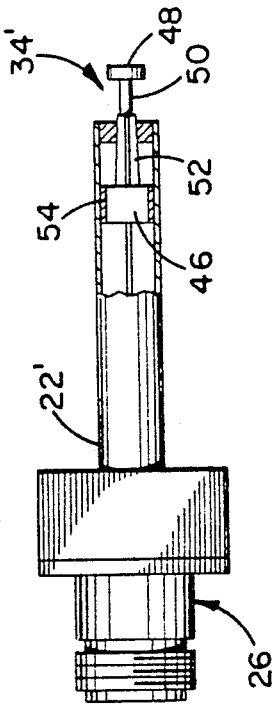
FIG. 6A illustrates a lowpass filter forming part of the integrated bandpass/lowpass filter according to the present invention, wherein the lowpass filter is housed within the input or output resonator of the bandpass filter, and illustrating the input coupling disk used to couple the output of the lowpass filter to the combline bandpass filter.
Figure 6C:
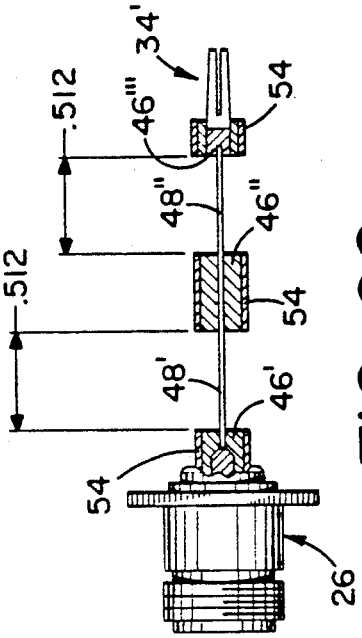
FIG. 6C is a cross-sectional view of the semi-lumped elements forming part of the lowpass suppression filter shown in FIGS. 6A.

As seen in FIGS. 6A, 6B and 6C, a lowpass filter 34' is housed within resonator 22' for providing the function of an inline lowpass filter without the associated extra connectors and space required in prior art designs. More particularly, a five pole chebyscheff lowpass filter is shown in FIG. 6C using semi-lumped elements, including low impedance elements 46', 46'' and 46''', and high impedance conductors 48' and 48''. The equivalent electrical schematic for such a filter is shown in FIG. 6D. Thus low impedance element 46', 46'', and 46''' respectively correspond to capacitors C1, C2 and C3 while high impedance elements 48' and 48'' respectively correspond to inductors L1 and L2.

As seen in FIGS. 7A and 6A, the output of the lowpass filter is coupled to the combline bandpass filter by means of disk 48 which in turn is coupled to the remaining elements of lowpass filter by means of rod 50 and center pin 52. As also seen in FIGS. 6A and 6C, cylindrical spacers 54 are positioned about each low impedance element 46', 46'' and 46''' so as to space these elements from the interior wall of resonator rod 20, The spacers act as dielectrics for the lowpass filter.

As seen in FIG. 7A, due to the fact that disk 48 protrudes within the cavity defined by rectangular cavity housing 44 in the same region where a tuning screw 24 would normally be located, the tuning screw 24' for resonator 22' protrudes through the lower sidewall 42 of cavity housing 44 in order to minimize interference with the coupling between the lowpass filter and the combline bandpass filter.

FIG. 7A also shows in phantom that a second lowpass filter 34,, may be placed within resonator 20'' positioned inline with connector 28.

The overall dimensions and element descriptions for the integrated bandpass/lowpass filter shown in FIGS. 7A–7C, including the lowpass filter details shown in FIGS. 6A–6C are presented in Table 1 below.

TABLE 1

(A) BANDPASS FILTER
Example presented is for a seven pole combline bandpass filter having a center bandpass frequency of approximately 1.45 GHz and a bandpass of approximately 40 MHz.

(1) Rectangular cavity housing 44
1.25 inches (3.175 cm) × 2.5 inches (6.35 cm) × 9.476 inches (24.07 cm) Material - aluminum extrusion with a wall thickness of 0.125 inch (0.318 cm).

(2) Resonator spacing starting with resonator 22' associated with connector 26.

| | | |
|---|---|---|
| from sidewall 43 to resonator 22' | 1 inch | (2.54 cm) |
| resonator 22' to 2nd resonator | 1.084 in. | (2.75 cm) |
| 2nd resonator to 3rd resonator | 1.310 in. | (3.33 cm) |
| 3rd resonator to 4th resonator | 1.144 in. | (2.91 cm) |
| 4th resonator to 5th resonator | 1.344 in. | (3.41 cm) |
| 5th resonator to 6th resonator | 1.310 in. | (3.33 cm) |
| 6th resonator to 7th resonator (22'') | 1.085 in. | (2.76 cm) |

(3) Resonator outer diameter 0.341 in. (0.87 cm), length 2.157 inches (5.48 cm), 0.025 inch (0.64 mm) wall thickness. Material - copper alloy 110 tube.

(B) INTEGRATED LOWPASS FILTERS
Low impedance elements (46', 46'', 46''') each fabricated from solid copper bushing material and each with an outer diameter of 0.206 inch (0.523 cm)

| | | |
|---|---|---|
| length of element 46' | 0.183 inch | (0.46 cm) |
| length of element 46'' | 0.512 inch | (1.30 cm) |
| length of element 46''' | 0.183 inch | (0.46 cm) |

high impedance elements (48' and 48'') each fabricated from hard drawn copper wire having a diameter of .020 inch (0.51 mm) and each having a length of 0.512 inch (1.30 cm).
center pin 52 fabricated from copper and having a length of 0.55 inch (1.40 cm).
disk 48 fabricated from silver plated brass and having a diameter of 0.203 (0.516 cm) and a thickness of .0625 inch (0.16 cm).
rod portion 50 having a length of 0.375 inch (0.952 cm).
spacers 54 each act as a capacitive dielectric and are fabricated from Teflon ® cylindrical sheathing having an outer diameter of 0.283 inch (0.72 cm).

Figure 8:
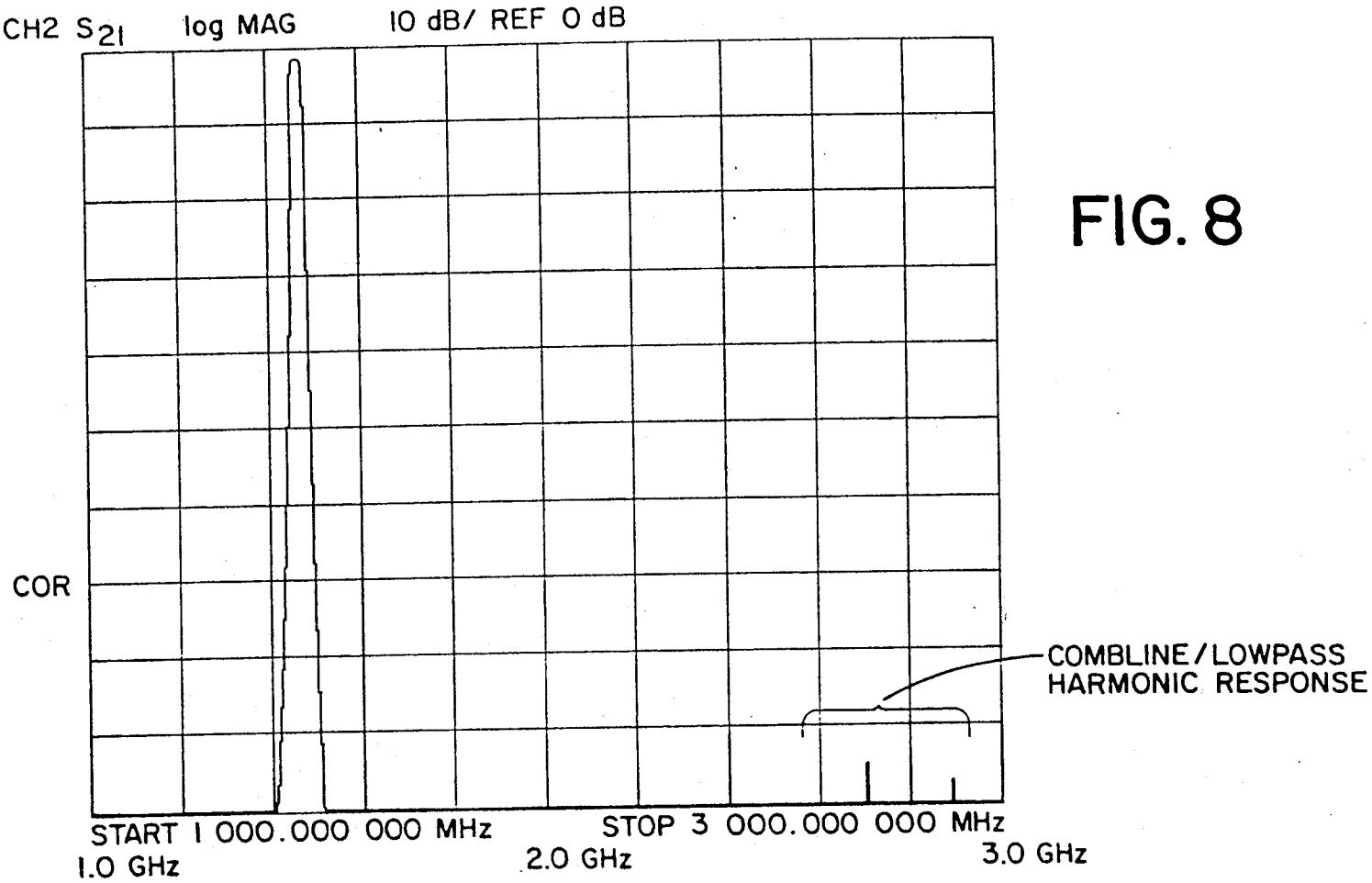
FIG. 8 illustrates a typical response curve for the integrated bandpass/lowpass filter shown in FIG. 7.

The overall response curve for this integrated bandpass/lowpass filter is shown in FIG. 8. As there seen, the magnitude of the spurious response is significantly reduced with this integrated filter as compared to a bandpass filter without an associated lowpass filters (see FIG. 3). In fact, this integrated filter has a response curve substantially the same as a conventional combline bandpass filter with two external lowpass filters such as shown in FIG. 5.

It is further seen that the connectors 25 and 27 required with external lowpass filters are completely eliminated in the present invention along with tube 29 of each lowpass filter. A comparison of FIG. 5 to FIG. 7A quickly reveals that for a given bandpass/lowpass filter combination, the present integrated bandpass/lowpass filter significantly reduces the space requirements and eliminates four connectors.

Consequently, the present invention achieves the desired response for a bandpass/lowpass filter combination in a manner which significantly reduces the space requirements and the number of connectors otherwise needed to achieve such a filter system.

Furthermore, although the disclosed embodiment of the present invention comprises a bandpass filter and a lowpass filter, the same integration technique can be applied to any combination filter using resonators for one portion of the filter and semi-lumped elements for the second portion of the filter.

It will thus be seen that the objects set forth above are efficiently attained, and, since certain changes may be made in the above construction without departing from the scope of the invention, it is intended that all matter contained in the above description and shown in the accompanying drawings shall be interpreted as illustrative and not in a limiting sense.

It is also to be understood that the following claims are intended to cover all of the generic and specific features of the invention described, and all statements of the scope of the invention which, as a matter of language, might be said to fall therebetween.

Having described the invention and what is claimed is:

1. An integrated bandpass/lowpass filter comprising:
(A) a bandpass filter having,
(1) a cavity,
(2) at least one resonator positioned within the cavity, and
(3) means for coupling electromagnetic energy into and out of the filter; and
(B) at least one integrated lowpass filter, each lowpass filter formed within one resonator of the bandpass filter, each lowpass filter having,
(1) at least one low impedance element positioned within the resonator,
(2) at least one high impedance element connected to the low impedance element and positioned within the resonator,
(3) means for coupling the output of the lowpass filter to the bandpass filter, and
(4) means for coupling the lowpass filter to the means for coupling electromagnetic energy into and out of the bandpass filter.

2. An integrated bandpass/lowpass filter as defined in claim 1, wherein the means for coupling the output of the lowpass filter to the bandpass filter comprises a disk extending beyond the resonator within which the low and high impedance elements of the lowpass filter are housed so as to be within the bandpass filter cavity, and a connecting rod connected at one end to one of the elements forming the lowpass filter and connected at its other end to the disk.

3. A integrated bandpass/lowpass filter as defined in claim 2, further comprising spacers positioned between the low impedance elements and the interior surface of the associated resonator so as to position the low impedance elements concentrically within the associated resonator.

4. An integrated bandpass/lowpass filter as defined in claim 3, wherein the low impedance elements of the lowpass filter are fabricated from metallic rod.

5. An integrated bandpass/lowpass filter as defined in claim 4, wherein the high impedance elements of the lowpass filter are fabricated from copper wire.

6. An integrated bandpass/lowpass filter as defined in claim 5, wherein the lowpass filter spacers are fabricated from Teflon ® sheathing so as to act as a capacitive dielectric.

7. An integrated bandpass/lowpass filter as defined in claim 6, wherein the bandpass filter further comprises, for each resonator, a tuning screw passing through the cavity and in proximity to the resonator.

8. An integrated bandpass/lowpass filter as defined in claim 7, wherein the bandpass filter is of a combline design and comprises seven resonators and wherein two lowpass filters are integrally formed within the first and last resonators of the combline filter, and further wherein each lowpass filter comprises three low impedance elements and two high impedance elements, with the high impedance elements interconnecting the three low impedance elements.

9. An integrated bandpass/lowpass filter as defined in claim 1, wherein the low impedance elements of the lowpass filter are fabricated from metallic rod.

10. An integrated bandpass/lowpass filter as defined in claim 9, wherein the high impedance elements of the lowpass filter are fabricated from copper wire.

11. An integrated bandpass/lowpass filter as defined in claim 1, wherein the high impedance elements of the lowpass filter are fabricated from copper wire.

12. An integrated bandpass/lowpass filter as defined in claim 1, wherein the means for coupling electromagnetic energy into and out of the filter comprises first and second connectors, each connector attached to the cavity so as to connect to one resonator.

13. A integrated bandpass/lowpass filter as defined in claim 1, further comprising non-conductive sheathing positioned between the low impedance elements and the interior surface of the associated resonator.

14. An integrated combline bandpass/lowpass filter comprising:

(A) a combline bandpass filter having,
  (1) a cavity,
  (2) N resonators positioned within the cavity, where N is an integer greater than one,
  (3) N tuning screws each passing through the cavity and each in proximity to one of the N resonators, and
  (4) first and second connectors each attached to the cavity and passing therethrough so as to connect each to one resonator; and (B) at least one integrated lowpass filter, each lowpass filter formed within one resonator of the combline bandpass filter, each lowpass filter having,
  (1) at least one low impedance element positioned within the resonator,
  (2) at least one high impedance element connected to the low impedance element and positioned within the resonator,
  (3) means for coupling the output of the lowpass filter to the bandpass filter, and
  (4) means for coupling the input of the lowpass filter to one of the connectors of the bandpass filter.

15. A integrated combline bandpass/lowpass filter as defined in claim 14, further comprising spacers positioned between the low impedance elements and the interior surface of the associated resonator so as to position the low impedance elements concentrically within the associated resonator.

16. An integrated combline bandpass/lowpass filter as defined in claim 15, wherein the low impedance elements of the lowpass filter are fabricated from metallic rod.

17. An integrated combline bandpass/lowpass filter as defined in claim 16, wherein the high impedance elements of the lowpass filter are fabricated from copper wire.

18. An integrated combline bandpass/lowpass filter as defined in claim 17, wherein the lowpass filter spacers are fabricated from Teflon ® sheathing so as to act as a dielectric.

19. An integrated combline bandpass/lowpass filter as defined in claim 18, wherein the combline filter comprises seven resonators and wherein two lowpass filters are integrally formed within the first and last resonators of the combline filter.

20. An integrated combline bandpass/lowpass filter as defined in claim 19, wherein each lowpass filter comprises three low impedance elements and two high impedance elements, with the high impedance elements interconnecting the three low impedance elements.

21. An integrated combination filter comprising:

(A) a resonator based filter having,
  (1) a cavity,
  (2) at least one resonator positioned within the cavity, and
  (3) means for coupling electromagnetic energy into and out of the filter; and (B) at least one integrated coaxial element filter, each coaxial element filter formed within one resonator of the resonator based filter, each coaxial element filter having,
  (1) at least one low impedance element positioned within the resonator,
  (2) at least one high impedance element connected to the low impedance element and positioned within the resonator,
  (3) means for coupling the output of the coaxial element filter to the resonator based filter, and
  (4) means for coupling the coaxial element filter to the means for coupling electromagnetic energy into and out of the resonator based filter.

22. An integrated combination filter as defined in claim 21, wherein the means for coupling the output of the coaxial element filter to the resonator based filter comprises a disk extending beyond the resonator within which the low and high impedance elements of the coaxial element filter are housed so as to be within the resonator based filter cavity, and a connecting rod connected at one end to one of the elements forming the coaxial element filter and connected at its other end to the disk.

23. A integrated combination filter as defined in claim 22, further comprising spacers positioned between the low impedance elements and the interior surface of the associated resonator so as to position the low impedance elements concentrically within the associated resonator.

24. An integrated combination filter as defined in claim 23, wherein the low impedance elements of the coaxial element filter are fabricated from metallic rod.

25. An integrated combination filter as defined in claim 24, wherein the high impedance elements of the coaxial element filter are fabricated from copper wire.

26. An integrated combination filter as defined in claim 25, wherein the coaxial element filter spacers are fabricated from Teflon® sheathing so as to act as a capacitive dielectric.

27. An integrated combination filter as defined in claim 26, wherein the resonator based filter further comprises, for each resonator, a tuning screw passing through the cavity and in proximity to the resonator.

28. An integrated combination filter as defined in claim 27, wherein the resonator based filter is of a combline design and comprises seven resonators and wherein two coaxial element filters are integrally formed within the first and last resonators of the combline filter.

29. An integrated combination filter as defined in claim 21, wherein the low impedance elements of the coaxial element filter are fabricated from metallic rod.

30. An integrated combination filter as defined in claim 29, wherein the high impedance elements of the coaxial element filter are fabricated from copper wire.

* * * * *

UNITED STATES PATENT AND TRADEMARK OFFICE

CERTIFICATE OF CORRECTION

PATENT NO. : 5,023,579

DATED : June 11, 1991

INVENTOR(S) : Bentivenga et al

It is certified that error appears in the above-identified patent and that said Letters Patent is hereby corrected as shown below:

At column 7, line 36, prior to the word 'means, please insert the words --bandpass filter comprises at least two resonators and wherein the--.

Signed and Sealed this

First Day of December, 1992

*Attest:*

DOUGLAS B. COMER

*Attesting Officer*

*Acting Commissioner of Patents and Trademarks*